US008322842B2

(12) United States Patent
Gordon et al.

(10) Patent No.: US 8,322,842 B2
(45) Date of Patent: Dec. 4, 2012

(54) GEL MAINTENANCE CYCLE FOR A RELEASE AGENT APPLICATION SYSTEM

(75) Inventors: Michael Cameron Gordon, West Linn, OR (US); Joseph Benjamin Gault, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 85 days.

(21) Appl. No.: 13/080,829

(22) Filed: Apr. 6, 2011

(65) Prior Publication Data

US 2012/0256979 A1 Oct. 11, 2012

(51) Int. Cl.
*B41J 2/01* (2006.01)

(52) U.S. Cl. ..... 347/103

(58) Field of Classification Search ..... 347/5, 22, 347/33, 34, 103
See application file for complete search history.

(56) References Cited

U.S. PATENT DOCUMENTS

| | | | | |
|---|---|---|---|---|
| 6,068,372 | A | 5/2000 | Rousseau et al. | |
| 6,176,575 | B1 | 1/2001 | Crawford et al. | |
| 6,755,519 | B2 | 6/2004 | Gelbart et al. | |
| 6,921,064 | B2 * | 7/2005 | Rousseau | 267/36.1 |
| 7,036,920 | B2 | 5/2006 | Rousseau et al. | |
| 7,677,717 | B2 | 3/2010 | Islam et al. | |
| 2005/0134666 | A1 | 6/2005 | Rousseau | |
| 2007/0139496 | A1 | 6/2007 | Leighton et al. | |
| 2007/0146459 | A1 | 6/2007 | Gault et al. | |
| 2007/0146460 | A1 | 6/2007 | Gordon et al. | |
| 2007/0146461 | A1 | 6/2007 | Islam et al. | |
| 2010/0231674 | A1 | 9/2010 | Domoto et al. | |
| 2010/0271451 | A1 | 10/2010 | Burress et al. | |

* cited by examiner

*Primary Examiner* — An Do

(74) *Attorney, Agent, or Firm* — Maginot, Moore & Beck, LLP

(57) ABSTRACT

An inkjet printer includes a controller configured to operate the printer in a gel maintenance cycle to clean residual ink and other material from an image receiving member in the printer to maintain image quality in the printer. The controller operates the image receiving member and a drum maintenance unit in the printer to flood the image receiving member with release agent that is removed from the member by wipers in the drum maintenance unit. The removed release agent is removed from a sump, filtered, and returned to an applicator for use in printing operations.

18 Claims, 4 Drawing Sheets

GEL MAINTENANCE CYCLE FOR A RELEASE AGENT APPLICATION SYSTEM

TECHNICAL FIELD

The apparatus and method described below relate to phase change inkjet printers, and more particularly to release agent application systems used in these printers.

BACKGROUND

Phase change inkjet printers receive phase change ink in a solid form, commonly referred to as ink sticks. Solid ink sticks are loaded into a printer and then melted to produce liquid ink that is used to form images on print media. Phase change inkjet printers form images using either a direct or an offset (or indirect) print process. In a direct print process, melted ink is jetted directly onto print media to form images. In an offset print process, melted ink is jetted onto a transfer surface, such as the surface of a rotating drum, belt, or band. Print media are moved proximate the surface of the rotating drum in synchronization with the ink images formed on the surface. The print media are then pressed against the surface on top of the ink images to transfer and affix the ink to the print media.

Offset phase change inkjet printers utilize drum maintenance systems to facilitate the transfer of ink images to the print media. Drum maintenance systems are typically configured to 1) lubricate the transfer surface with a very thin, uniform layer of release agent (e.g., silicone oil) before each print cycle, and 2) remove and store any excess oil, ink and debris from the surface of the drum after each print cycle.

To perform these functions, a drum maintenance system is usually equipped with a reservoir that contains a supply of release agent, and an applicator for delivering the release agent from the reservoir to the transfer surface. One or more elastomeric metering blades are also used to meter the release agent onto the transfer surface at a desired thickness and to divert excess release agent, residual ink left on the transfer surface, and other debris that may collect on the transfer surface to a reclaim area of the drum maintenance system. The collected release agent is filtered to enable its reuse in the printing system.

Over time, the ink material and debris collected in the drum maintenance system may combine with the release agent to form a high viscosity gel. As the gel accumulates in the system, the gel may adhere to the working edges of the elastomeric blade(s). The gel buildup on the blade(s) can impair metering performance. In some cases, the gel may adhere to the transfer surface and possibly cause print quality defects or inkjet contamination.

SUMMARY

To address the accumulation of gel in a release agent application system of an imaging device, a method of operating the release agent application system has been developed. According to the method, print operations are first disabled. With print operations disabled, release agent is pumped from a reservoir to a reclaim receptacle of the release agent application system until the reclaim receptacle is substantially filled with release agent. After filling the reclaim receptacle with release agent, a release agent applicator and a metering blade of the release agent application system are moved into engagement with an image transfer surface of an image receiving member in the imaging device. The image receiving member is then rotated for a predetermined duration while maintaining the release agent applicator and the metering blade in engagement with the image transfer surface. The release agent applicator is at least partially submerged in the release agent in the reclaim receptacle and is configured to deliver the release agent from the reclaim receptacle to the image transfer surface. The metering blade is positioned to meter the delivered release agent onto the image transfer surface. After the predetermined duration, the release agent applicator and the metering blade are moved out of contact with the image transfer surface. Printing operations are then enabled.

In another embodiment, an imaging device is configured to perform the above-described method. The imaging device comprises a rotatable image receiving member having an image transfer surface, and a printing system configured to deposit ink onto the image transfer surface. A release agent application system for the imaging device includes a reservoir containing a supply of release agent, a reclaim receptacle, a delivery pump system for pumping release agent from the reservoir to the reclaim receptacle, a sump positioned to capture excess release agent delivered to the reclaim receptacle, a sump pump system for pumping release agent from the sump to the reservoir, and an applicator positioned at least partially in the reclaim receptacle so as to be at least partially submerged in release agent received therein. The applicator is configured for selective engagement with the image transfer surface to apply release agent from the reclaim receptacle to the image transfer surface. The release agent application system also includes a metering blade configured for selective engagement with the image transfer surface to meter the applied release agent onto the image transfer surface. The metering blade is configured to divert excess release agent from the image transfer surface to the reclaim receptacle. A controller is operatively connected to the image receiving member, delivery pump system, the sump pump system, applicator, and metering blade. The controller is configured to operate the release agent application system to perform a maintenance cycle. During the maintenance cycle, print operations are disabled. With print operations disabled, release agent is pumped from the reservoir to the reclaim receptacle until the reclaim receptacle is substantially filled with release agent. After filling the reclaim receptacle with release agent, the applicator and the metering blade are moved into engagement with the image transfer surface. The image receiving member is rotated for a predetermined duration while maintaining the applicator and the metering blade in engagement with the image transfer surface. After the predetermined duration, the applicator and the metering blade are each moved out of contact with the image transfer surface. Print operations are enabled after moving the applicator and the metering blade out of contact with the image transfer surface.

DETAILED DESCRIPTION

Figure 1:
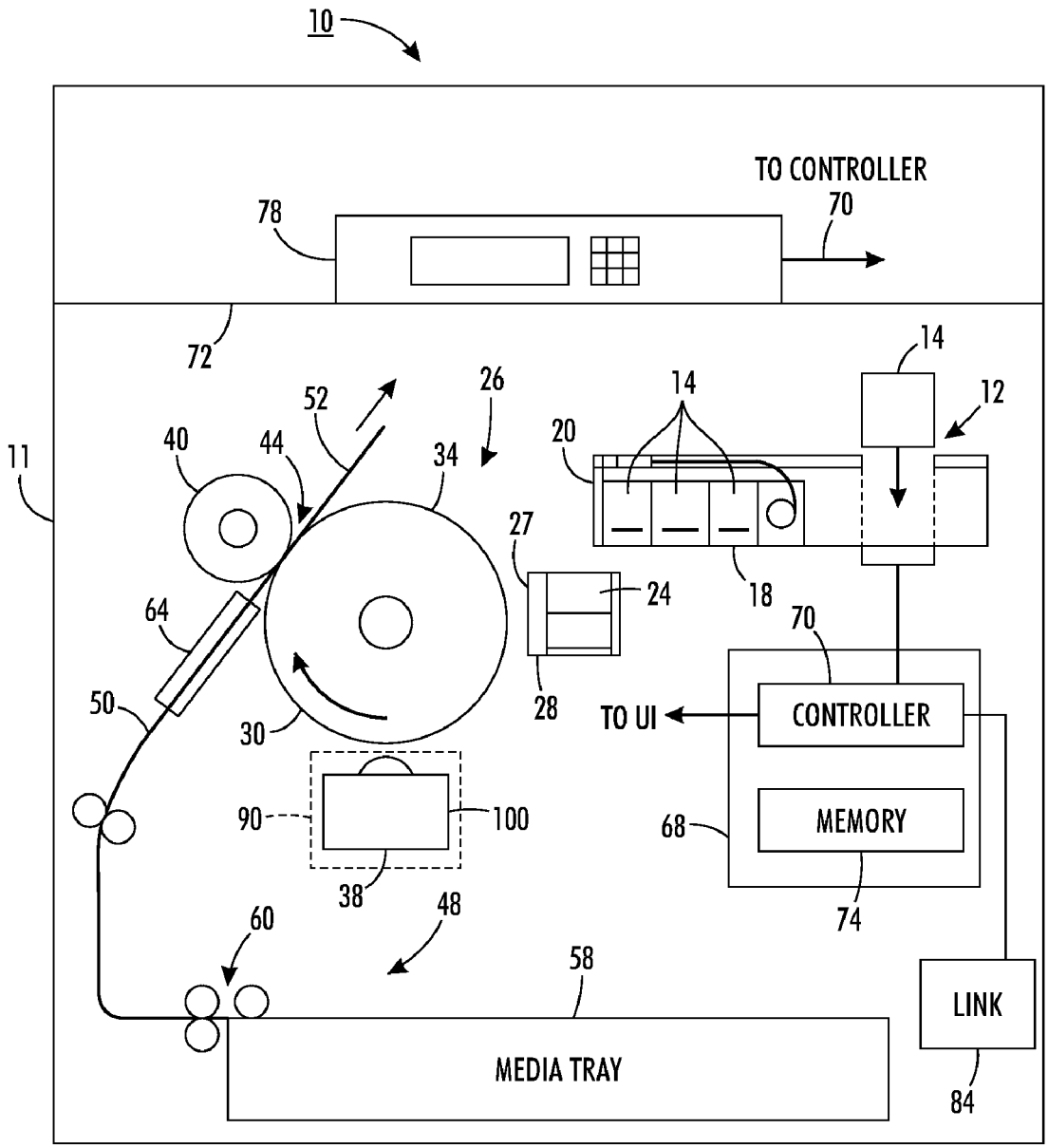
FIG. 1 is a schematic view of an indirect phase change inkjet printing system including a rotatable image receiving member having an image transfer surface.

The description below and the accompanying figures provide a general understanding of the environment for the system and method disclosed herein as well as the details for the system and method. In the drawings, like reference numerals are used throughout to designate like elements. The word "printer" as used herein encompasses any apparatus that generates an image on media with ink. The word "printer" includes, but is not limited to, a digital copier, a bookmaking machine, a facsimile machine, a multi-function machine, or the like.

FIG. 1 is a side schematic view of a phase change inkjet printing device 10 configured to utilize an image receiving, bearing, or contacting member 34 to transfer image material to a print sheet. The printing device 10 is equipped with a release agent application system 100 that utilizes one or more elastomeric blades 120, 124 (FIGS. 2 and 3) to meter release agent onto an image transfer surface 30 of the image receiving member 34 and to divert excess release agent, ink residue, and debris from the transfer surface to a reclaim area. In accordance with the present disclosure, the release agent application system 100 is configured to perform a gel maintenance cycle (GMC) periodically to remove contamination from the blade(s). Although the gel maintenance cycle is described below in conjunction with a release agent application system for a phase change inkjet printing system, a gel maintenance cycle in accordance with this disclosure may be utilized with release agent application systems for other image marking systems that utilize an image receiving, bearing, or contacting member to transfer image material to a print sheet, such as a fuser roll in a xerographic printer or an ink spreader in a phase change ink printer that utilizes a direct print process.

FIG. 1 depicts the relationship between the DMU 100 and the other components of the exemplary phase change inkjet printing device 10. The device 10 includes a housing 11 that supports and at least partially encloses an ink loader 12, a printing system 26, a media supply and handling system 48, and a control system 68. The ink loader 12 receives and delivers solid ink to a melting device for generation of liquid ink. The printing system includes a plurality of inkjet ejectors that is fluidly connected to receive the melted ink from the melting device. The inkjet ejectors eject drops of liquid ink onto the image transfer surface 30 under the control of system 68. The media supply and handling system 48 extracts media from one or more media supplies in the printer 10, synchronizes delivery of the media to a transfix nip for the transfer of an ink image from the image receiving surface to the media, and then delivers the printed media to an output area.

In more detail, the ink loader 12 is configured to receive phase change ink in solid form, such as blocks of ink 14, which are commonly called ink sticks. The ink loader 12 includes feed channels 18 into which ink sticks 14 are inserted. Although a single feed channel 18 is visible in FIG. 1, the ink loader 12 includes a separate feed channel for each color or shade of color of ink stick 14 used in the printer 10. The feed channel 18 guides ink sticks 14 toward a melting assembly 20 at one end of the channel 18 where the sticks are heated to a phase change ink melting temperature to melt the solid ink to form liquid ink. Any suitable melting temperature may be used depending on the phase change ink formulation. In one embodiment, the phase change ink melting temperature is approximately 80° C. to 130° C.

The melted ink from the melting assembly 20 is directed gravitationally or by actuated systems, such as pumps, to a melt reservoir 24. A separate melt reservoir 24 may be provided for each ink color, shade, or composition used in the printer 10. Alternatively, a single reservoir housing may be compartmentalized to contain the differently colored inks. As depicted in FIG. 1, the ink reservoir 24 comprises a printhead reservoir that supplies melted ink to inkjet ejectors 27 formed in the printhead(s) 28. The ink reservoir 24 may be integrated into or intimately associated with the printhead 28. In alternative embodiments, the reservoir 24 is a separate or independent unit from the printhead 28. Each melt reservoir 24 may include a heating element (not shown) operable to heat the ink contained in the corresponding reservoir to a temperature suitable for melting the ink and/or maintaining the ink in liquid or molten form, at least during appropriate operational states of the printer 10.

The printing system 26 includes at least one printhead 28. One printhead 28 is shown in FIG. 1 although any suitable number of printheads 28 may be used. The printhead 28 is operated in accordance with firing signals generated by the control system 68 to eject drops of ink toward the image receiving surface 30. The device 10 of FIG. 1 is an indirect printer configured to use an indirect printing process in which the drops of ink are ejected onto the intermediate transfer surface 30 and then transferred to print media. In alternative embodiments, the device 10 is configured to eject the drops of ink directly onto print media.

The image receiving member 34 is shown as a drum in FIG. 1, although in alternative embodiments the image receiving member 34 is a moving or rotating belt, band, roller or other similar type of structure. A transfix roller 40 is loaded against the transfer surface 30 of the image receiving member 34 to form a nip 44 through which sheets of print media 52 pass. The sheets are fed through the nip 44 in timed registration with an ink image formed on the transfer surface 30 by the inkjets of the printhead 28. Pressure (and in some cases heat) is generated in the nip 44 to facilitate the transfer of the ink drops from the surface 30 to the print media 52 while substantially preventing the ink from adhering to the image receiving member 34.

The media supply and handling system 48 of printer 10 transports print media along a media path 50 that passes through the nip 44. The media supply and handling system 48 includes at least one print media source, such as supply tray 58. The media supply and handling system also includes suitable mechanisms, such as rollers 60, which may be driven or idle rollers, as well as baffles, deflectors, and the like, for transporting media along the media path 50.

Media conditioning devices may be positioned at various points along the media path 50 to thermally prepare the print media to receive melted phase change ink. In the embodiment of FIG. 1, a preheating assembly 64 is utilized to bring print media on media path 50 to an initial predetermined temperature prior to reaching the nip 44. Media conditioning devices, such as the preheating assembly 64, may rely on radiant, conductive, or convective heat or any combination of these heat forms to bring the media to a target preheat temperature, which in one practical embodiment, is in a range of about 30° C. to about 70° C. In alternative embodiments, other thermal conditioning devices may be used along the media path before, during, and after ink has been deposited onto the media.

A control system 68 aids in operation and control of the various subsystems, components, and functions of the printer 10. The control system 68 is operatively connected to one or more image sources (not shown), such as a scanner system or a work station connection, to receive and manage image data from the sources and to generate control signals that are delivered to the components and subsystems of the printer. Some of the control signals are based on the image data, such as the firing signals, and these firing signals operate the printheads as noted above. Other control signals, for example, control the operating speeds, power levels, timing, actuation, and other parameters, of the system components to cause the imaging device 10 to operate in various states, modes, or levels of operation, referred to collectively herein as operating modes. These operating modes include, for example, a startup or warm up mode, shutdown mode, various print modes, maintenance modes, and power saving modes. In an embodiment discussed in this document, the control system is configured to implement a gel maintenance cycle mode of operation. In a gel maintenance cycle mode of operation, the control system 68 operates the image receiving member and drum maintenance unit as described below to clean the image receiving member and preserve image quality in the printer.

The control system 68 includes a controller 70, electronic storage or memory 74, and a user interface (UI) 78. The controller 70 comprises a processing device, such as a central processing unit (CPU), an application specific integrated circuit (ASIC), a field programmable gate array (FPGA) device, or a microcontroller. Among other tasks, the processing device processes images provided by the image sources 72. The one or more processing devices comprising the controller 70 are configured with programmed instructions that are stored in the memory 74. The controller 70 executes these instructions to operate the components and subsystems of the printer. Any suitable type of memory or electronic storage may be used. For example, the memory 74 may be a non-volatile memory, such as read only memory (ROM), or a programmable non-volatile memory, such as EEPROM or flash memory.

User interface (UI) 78 comprises a suitable input/output device located on the imaging device 10 that enables operator interaction with the control system 68. For example, UI 78 may include a keypad and display (not shown). The controller 70 is operatively connected to the user interface 78 to receive signals indicative of selections and other information input to the user interface 78 by a user or operator of the device. Controller 70 is operatively connected to the user interface 78 to display information to a user or operator including selectable options, machine status, consumable status, and the like. The controller 70 may also be coupled to a communication link 84, such as a computer network, for receiving image data and user interaction data from remote locations.

Figure 2:
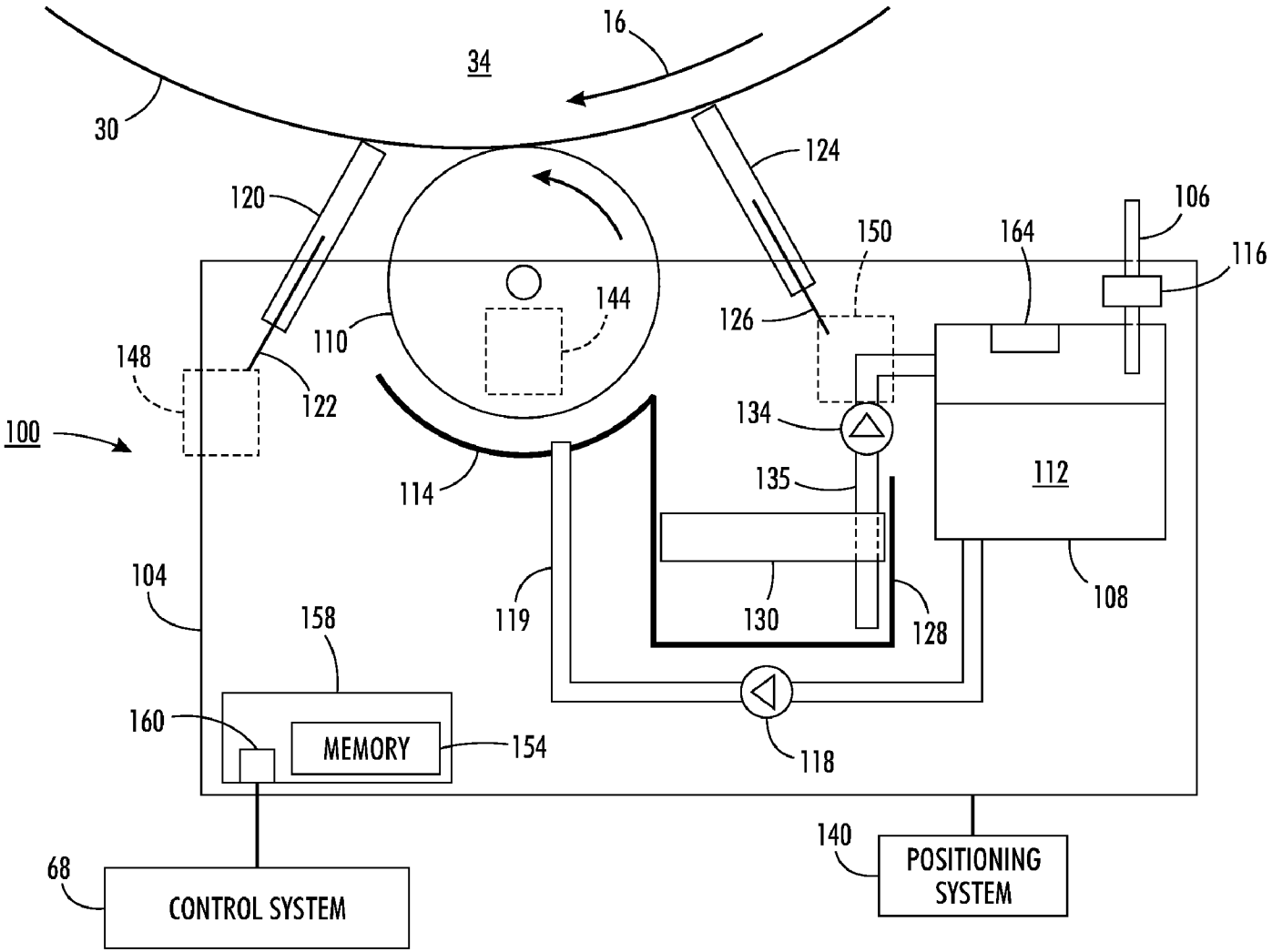
FIG. 2 is a schematic view of drum maintenance system of the printing system of FIG. 1 in an engaged position with respect to the image transfer surface.
Figure 3:
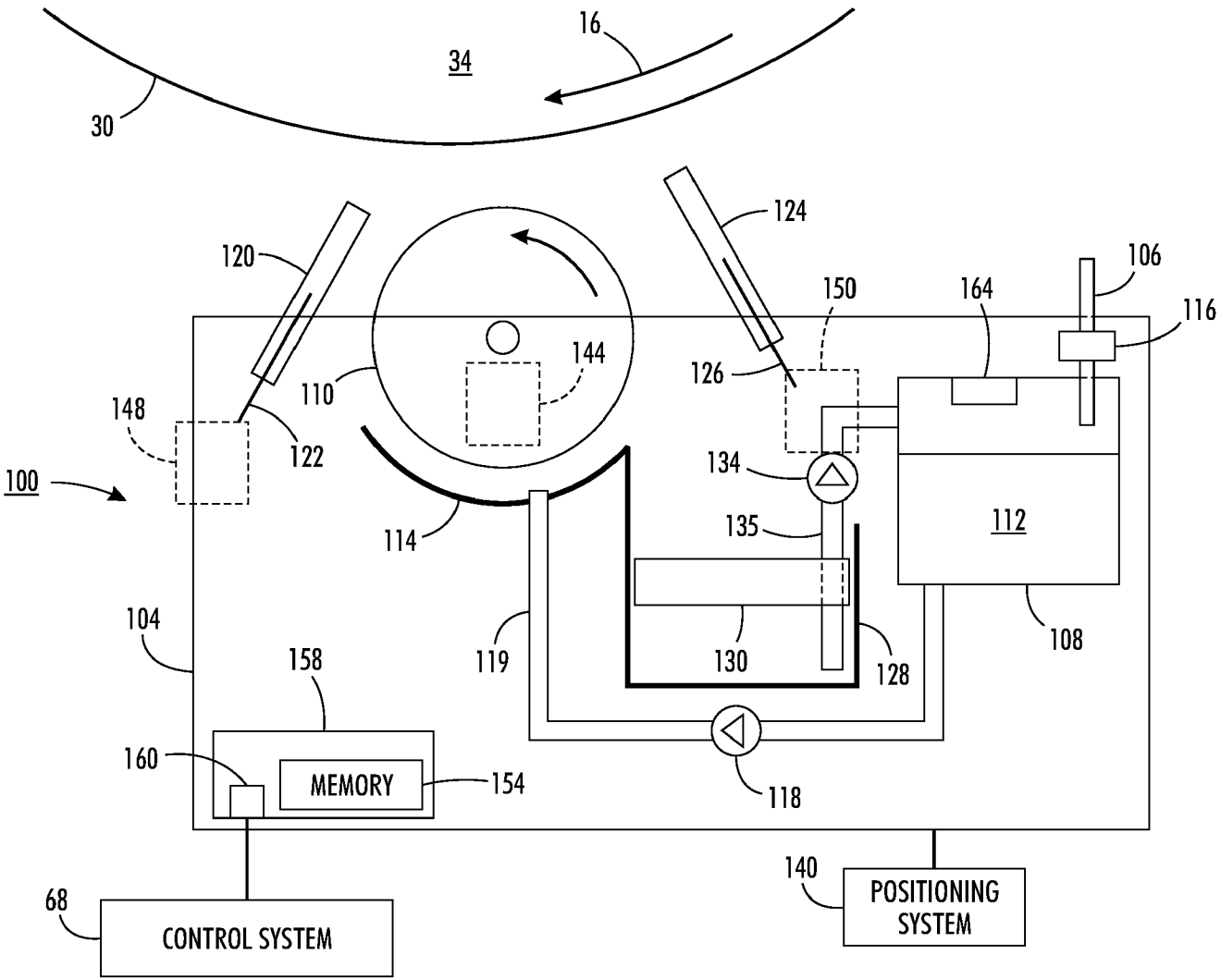
FIG. 3 is a schematic view of the drum maintenance system of FIG. 2 in a disengaged position with respect to the image transfer surface.

To facilitate transfer of an ink image from the drum to print media, the device 10 is provided with a release agent application system 100, referred to as a drum maintenance unit (DMU), for applying release agent to the surface 30 of the image receiving member 34. Referring to FIGS. 2 and 3, the DMU 100 includes a housing 104, a reservoir 108, an applicator 110, a reclaim area 114, a pump delivery system 118, a metering blade 120, a cleaning blade 124, a sump 128, a filter 130, a sump pump system 134, a positioning system 140, and a memory 154.

The DMU housing 104 is formed of a material, such as molded plastic, that is compatible with the release agent used in the device 10 and that is capable of withstanding the environment within the housing 11 of the printer 10 during operational use of the printer. The reservoir 108 is positioned within the housing and is configured to hold a supply of release agent 112. A vent tube or conduit 106 fluidly connects the interior of the reservoir 108 to atmosphere to relieve any positive or negative pressure developed in the reservoir. The vent tube includes a solenoid valve 116 that is normally closed to prevent any oil leaks during shipping and customer handling. The solenoid valve 116 is opened as oil is being pumped into and out of the oil reservoir to allow the reservoir to vent to atmospheric pressure.

In some embodiments, the reservoir 108 is equipped with a pressure sensor 164, such as a pressure transducer, which is configured to directly or indirectly detect or measure the pressure in reservoir 108. As discussed below, the pressure sensor 164 may be used after a maintenance cycle is performed to determine a change in pressure in the reservoir as a result of pumping release agent to or from the reservoir. The change in pressure may then be used to determine a duration for maintaining the solenoid valve 106 opened after pumping has been completed to return the pressure to ambient.

The applicator 110 is configured to apply the release agent 112 from the reservoir 108 to the transfer surface 30. In the embodiment of FIG. 2, the applicator 110 comprises a roller formed of an absorbent material, such as extruded polyurethane foam. In other embodiments, the applicator 110 is provided in a number of other shapes, forms, and/or materials that enables release agent from the reservoir 108 to be applied to the surface 30. For example, in other embodiments, the applicator 110 is comprised of a blotter or pad formed of an absorbent low-friction material that is pressed against the transfer surface 30 to apply release agent.

To facilitate saturation of the roller 110 with the release agent, the roller 110 is positioned over a reclaim area 114 in the form of a tub or trough, referred to herein as a reclaim trough. A release agent delivery system 118 is configured to pump release agent from the reservoir through a conduit 119, or other suitable flow path, to the reclaim trough 114. In one embodiment, the delivery system 118 comprises a peristaltic pump although any suitable type of fluid pump or fluid transport system may be used.

In the embodiment of FIG. 2, the reclaim trough 114 has a bottom surface that follows the cylindrical profile of the lower portion of the roller 110. The roller 110 is positioned with respect to the reclaim trough 114 so that it is partially submerged in release agent. In some embodiments, the bottom surface of the trough includes surface features (not shown), such as chevrons, that protrude from the surface and are shaped or angled to direct oil from the outer edges of the roller toward the center.

The metering blade 120 is positioned to meter the release agent applied to the surface 30 by the roller 110. The metering blade 120 may be formed of an elastomeric material such as urethane supported on an elongated metal support bracket 122. The metering blade 120 helps insure that a uniform thickness of the release agent is present across the width of the surface 30. In addition, the metering blade 120 is positioned above the reclaim trough 114 so that excess oil metered from the surface 30 by blade 120 is diverted down the metering blade 120 and back to the reclaim trough 114.

The DMU 100 also includes a cleaning blade 124 that is positioned to scrape oil and debris, such as paper fibers, residual ink and the like, from the surface 30 prior to a fresh application of release agent by roller 110. In particular, after an image is fixed onto a print media, the portion of the drum upon which the image was formed is contacted by the cleaning blade 124. Similar to the metering blade 120, the cleaning blade 124 may be formed of an elastomeric material such as urethane supported on an elongated metal support bracket 126. The cleaning blade 124 is positioned above the reclaim trough 114 so that oil and debris scraped off of the surface 30 is directed to the sump 128.

The sump 128 comprises a receptacle or compartment positioned to capture excess release agent delivered to the reclaim trough 114, as well as release agent, dust, dried ink, and other debris diverted from the transfer surface 30. The sump 128 is fluidly connected to the reservoir 108 by a conduit 135. A sump pump 134 is configured to pump release agent from the sump 128 through the conduit 135 to the reservoir 108. A filter 130 is positioned in the sump 134 that ink, oil, and debris must pass through prior to being pumped to the reservoir 108. In one embodiment, the sump pump 134 comprises a peristaltic pump although any suitable pumping system or method may be used that enables the release agent to be pumped to the reservoir from the sump 128.

In the embodiment of FIGS. 1 and 2, the DMU 100 is implemented as a customer replaceable unit (CRU). As used herein, a CRU is a self-contained, modular unit that enables all or most of the components of the CRU to be inserted into and removed from a printer as a functional self-contained unit. When implemented as a CRU, the components of the DMU, such as the housing 104, reservoir 108, release agent supply 112, and applicator 110, and blades 120, 124 are configured in a modular form capable of being inserted into and removed from the housing 11 of the device 10 as single component. As depicted in FIG. 1, the device 10 includes a docking space or area 90 (shown schematically as a dotted line in FIG. 1) in the housing 11 for receiving the DMU 100. The device 10 and/or the DMU housing 104 may be provided with suitable attachment features (not shown), such as fastening mechanisms, latches, positioning guide features, and the like, to enable the correct placement of the DMU 100 within the housing 11.

The DMU 100 includes a positioning system 140 that enables the applicator 110, metering blade 120, and cleaning blade 124 to be selectively moved into and out of engagement with the surface 30 once inserted into the housing. For example, the positioning system may include a moveable member that interacts with a cam in the housing 11 of the printing device 10. In the embodiment of FIG. 2, the positioning system includes a separate respective positioning mechanism 144, 148, 150, such as a cam follower, for each of the applicator 110, metering blade 120, and cleaning blade 124 so that each may be moved into and out of engagement with the transfer surface 30 independently. The positioning mechanisms of the positioning system are configured to enable the applicator 110, metering blade 120, and cleaning blade 124 to be selectively and independently moved between a disengaged position (FIG. 3) spaced apart from the surface 30 and an engaged position (FIG. 2) in contact with the transfer surface 30. In an alternative embodiment, the positioning mechanism 140 may be configured so that the DMU is moved between an engaged position and a disengaged position with respect to the transfer surface as a unit.

As a CRU, the DMU 100 has an expected lifetime, or useful life, that corresponds to the amount of oil loaded in the DMU reservoir 108. When the supply of release agent in a DMU has been depleted, the DMU may be removed from its location or slot 90 in the device and replaced with another DMU. Referring again to FIG. 2, the DMU 100 includes a memory device 136, such as an EEPROM, for storing operational values and other information pertaining to the DMU 100, such as the current mass or volume of release agent in the reservoir, the number of pages printed using the DMU 100, and, as explained below, maintenance information used in performing a gel maintenance cycle for the DMU.

The memory 154 may be implemented in a circuit board 158 or other structure. The circuit board 158 includes a suitable connecting structure 160 configured to releasably and electrically connect the circuit board 138 including memory 154 to the printer control system 68 when the DMU 100 is installed in the housing 11. Once the DMU 100 is inserted into the device 10 and the memory 154 is connected to the controller 70, the control system 68 may access the memory 154 to retrieve the operational values and may write to the memory 154 to update the values during use. In this manner, DMU performance and life expectancy may be tracked. In addition, various controllable components of the DMU 100, such as the solenoid valve 116, delivery pump 118, sump pump 134, pressure sensor 164, and the actuators 144, 148, 150 of the positioning system 140 are each operatively connected to the circuit board 158 so that they may be controlled by the control system 68 of the printing device.

Over time, the ink material and debris collected in the DMU may combine with the release agent to form a high viscosity gel that can cling to the working edge of the metering blade. The gel buildup on the metering blade can contaminate the transfer surface and possibly result in print quality defects and inkjet contamination. To remove and/or prevent gel buildup on the metering blade of the DMU, the DMU 100 is configured to perform a gel maintenance cycle (GMC) periodically.

In accordance with one embodiment of the GMC, the applicator 110, the metering blade 120, and the cleaning blade 124 are moved to their engaged positions with respect to the transfer surface for a predetermined prolonged period of time relative to engagement times during normal operations. The applicator 110 continuously applies release agent to the transfer surface 30 that is metered onto the surface 30 by the metering blade. As the metering blade meters the release agent, the release agent contacts the buildup of gel and contaminants on the blade. The prolonged contact between the release agent and the gel buildup on the metering blade during this cycle provides time for the release agent to break down the gel buildup and remove the buildup from the metering blade.

Figure 4:
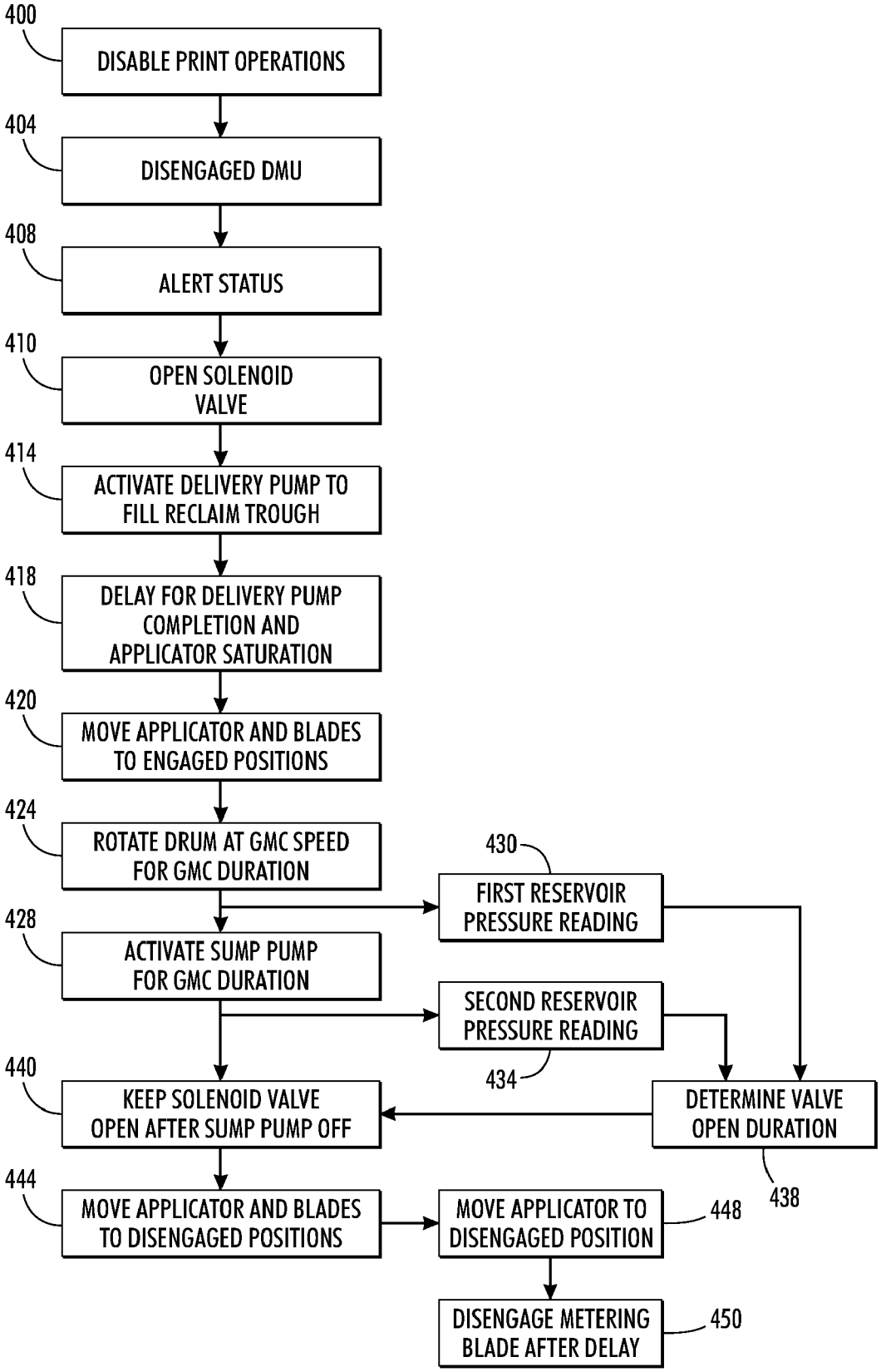
FIG. 4 is a flowchart of a gel maintenance cycle for the drum maintenance system of FIGS. 2 and 3.

Referring to FIG. 4, a flowchart depicting an embodiment of a gel maintenance cycle is illustrated. A gel maintenance cycle begins with the disabling of printing operations (block 400) and the disengagement of the applicator 110, the metering blade 120, and the cleaning blade 124 of the DMU from the transfer surface 30 (block 404). Prior to or at the start of the maintenance cycle, an alert is generated via the user interface indicating that a gel maintenance cycle is being performed and that the DMU should not be removed (block 408). With the DMU disengaged, the solenoid valve 116 is opened (block 410) to allow the reservoir to vent to atmospheric pressure as release agent is pumped to and from the reservoir 108.

The delivery pump is then activated and run for a predetermined period of time in order to fill the reclaim receptacle of the DMU with release agent (block 414). The delivery pump is run with the DMU disengaged so that the reclaim trough can be filled and at capacity prior to the applicator and metering blade being moved into engagement with the transfer surface. In the embodiment of the DMU depicted in FIGS. 1-3, the time period for running the delivery pump to fill the reclaim trough with release agent is approximately 60 seconds.

After a suitable delay (block 418), the respective positioning systems 144, 148, 150 of the applicator 110, the metering blade 120, and the cleaning blade 124 are actuated to move the applicator 110, the metering blade 120, and the cleaning blade 124 from their disengaged to their engaged positions with respect to the transfer surface 30 (block 420). The delay is selected to provide time for the delivery pump cycle to be completed and for the oil in the reclaim receptacle to completely saturate the applicator, i.e., reach the center of the roller. After the DMU is in the engaged position, the drum is rotated at a predetermined rate of speed for a predetermined duration with the applicator and blade in engagement with the transfer surface (block 424).

As the drum rotates, the applicator maintains a constant puddle or "oil dam" in front of the metering blade that the metering blade distributes over the drum surface at a predetermined thickness. As the metering blade distributes the release agent, the release agent contacts the buildup of gel and contaminants on the blade. The metering blade and applicator are maintained in engagement with the transfer surface in this manner for a predetermined duration to provide time for the release agent to break down the gel buildup and remove the buildup from the metering blade. In the embodiment of FIGS. 1-3, the metering blade and applicator are maintained in engagement with the drum for approximately 120 sec. while the drum is rotated at approximately 254 mm/sec. The duration and the speed of rotation, however, may be set at any suitable value that enables a desired amount of buildup to be removed from the blade during the drum maintenance cycle.

The sump pump is activated while the applicator and metering blade are positioned in engagement with the drum to pump reclaimed release agent to the reservoir (block 428). During the DMU maintenance cycle of the DMU embodiment of FIGS. 1-3, the sump pump is run for approximately 120 sec. In one embodiment, before running the sump pump, the solenoid valve is closed and the pressure in the reservoir is detected a first time to determine the ambient pressure in the reservoir (block 430). After the sump pump is stopped, the pressure in the reservoir is detected a second time to determine the pressure drop from ambient due to pumping (block 434). Based directly or indirectly on the detected pressure drop, a time period is determined to leave the solenoid valve open after stopping the sump pump for the pressure in the reservoir to return to ambient (block 438). The solenoid valve is then left open for the determined duration after the sump pump has stopped running (block 440).

At the end of the maintenance cycle, the applicator, the metering blade, and the cleaning blade are moved away from the drum surface to their disengaged positions (blocks 444). In some cases after removal, the applicator may leave a blot of release agent on the drum surface where the applicator was located. Accordingly, in one embodiment, the metering blade and cleaning blade are maintained in the engaged position (block 448) for a period of time after the applicator has been removed (block 450) from the drum surface to ensure that the blot of release agent due to removal of the applicator is wiped from the surface of the drum. After the applicator, the metering blade, and the cleaning blade have been moved to their disengaged positions and the solenoid valve has been closed, the printing device may be enabled to perform print operations.

A GMC may be executed at predetermined intervals and/or times during DMU operation. In one embodiment, a GMC may be scheduled to be performed every 5,000 print cycles. An initial GMC cycle may be scheduled to be performed only after a certain number of print cycles have been performed by the DMU. For example, in one embodiment, an initial GMC may be performed after 25,000 prints. As mentioned above, the number of print cycles performed by the DMU may be tracked and updated in the DMU memory by the controller. The intervals and/or times for performing a GMC may be predetermined and stored in one or both of the DMU memory and control system memory for access by the controller. In one embodiment, the controller is configured to determine and/or adjust the intervals and/times for executing a GMC based on a number of factors, such as usage rates, print job characteristics, and/or environmental conditions. The controller is also configured to detect a number of print pages or accumulated time since a last GMC or some similar GMC cycle metric reaching a threshold indicative of a time for performance of a GMC. In one embodiment, intervals and/times for performing a GMC may be determined based on the usage rates and times tracked as part of the intelligent ready mode of operation of the printer.

It will be appreciated that variations of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A method of operating a release agent application system of an imaging device, the method comprising:

disabling print operations;

with print operations disabled, pumping release agent from a reservoir of a release agent application system of an imaging device to a reclaim receptacle of the release agent application system until the reclaim receptacle is substantially filled with release agent;

after filling the reclaim receptacle with release agent, moving a release agent applicator and a metering blade of the release agent application system into engagement with an image transfer surface of an image receiving member;

rotating the image receiving member for a predetermined duration while maintaining the release agent applicator and the metering blade in engagement with the image transfer surface, the release agent applicator being at least partially submerged in the release agent in the reclaim receptacle and configured to deliver the release agent from the reclaim receptacle to the image transfer surface, the metering blade being positioned to meter the delivered release agent onto the image transfer surface;

after the predetermined duration, moving the release agent applicator out of contact with the transfer surface and moving the metering blade out of contact with the transfer surface; and enabling print operations.

2. The method of claim 1, further comprising:

opening a solenoid valve of the release agent application system while pumping release agent from the reservoir to the reclaim receptacle, the solenoid valve being operatively connected to a vent tube for venting the reservoir to ambient pressure.

3. The method of claim 1, further comprising:

generating an alert through a user interface of the imaging device, the alert indicating that a maintenance cycle is being performed.

4. The method of claim 1, wherein the rotation of the image receiving member further comprises:

rotating the image receiving member for approximately 120 seconds.

5. The method of claim 1, wherein moving the release agent applicator and the metering blade out of contact with the transfer surface further comprises:

after a predetermined delay subsequent to moving the release agent applicator out of contact with the transfer surface, moving the metering blade out of contact with the transfer surface.

6. The method of claim 1, further comprising:

activating a sump pump of the release agent application system while rotating the image receiving member for the predetermined duration.

7. The method of claim 6, further comprising:

detecting a first pressure in the reservoir prior to activating the sump pump;

detecting a second pressure in the reservoir after the sump pump has been deactivated; and keeping a solenoid valve of the release agent application system open for a second predetermined duration after deactivating the sump pump, the second predetermined duration being determined with reference to a difference between the first pressure and the second pressure.

8. The method of claim 1, further comprising:

moving the release agent applicator and the metering blade out of contact with the transfer surface prior to pumping release agent from the reservoir to the reclaim receptacle.

9. The method of claim 1, wherein pumping release agent from the reservoir to the reclaim receptacle further comprises:

activating a delivery pump to pump release agent from the reservoir to the reclaim receptacle for approximately 60 seconds.

10. The method of claim 1, wherein the imaging device comprises a phase change ink imaging device.

11. An imaging device comprising:

a rotatable image receiving member having an image transfer surface;

a printing system configured to deposit ink onto the image transfer surface;

a release agent application system including:

a reservoir containing a supply of release agent;

a reclaim receptacle;

a delivery pump system for pumping release agent from the reservoir to the reclaim receptacle;

a sump positioned to capture excess release agent delivered to the reclaim receptacle;

a sump pump system for pumping release agent from the sump to the reservoir;

an applicator positioned at least partially in the reclaim receptacle so as to be at least partially submerged in release agent received therein, the applicator being configured for selective engagement with the image transfer surface to apply release agent from the reclaim receptacle to the image transfer surface;

a metering blade configured for selective engagement with the image transfer surface to meter the applied release agent onto the image transfer surface, the metering blade being configured to divert excess release agent from the image transfer surface to the reclaim receptacle;

a controller operatively connected to the image receiving member, delivery pump system, the sump pump system, applicator, and metering blade, the controller being configured to operate the release agent application system to perform a maintenance cycle;

wherein, during the maintenance cycle:

print operations are disabled;

with print operations disabled, release agent is pumped from the reservoir to the reclaim receptacle until the reclaim receptacle is substantially filled with release agent;

after filling the reclaim receptacle with release agent, the applicator and the metering blade are moved into engagement with the image transfer surface;

the image receiving member is rotated for a predetermined duration while maintaining the applicator and the metering blade in engagement with the image transfer surface, after the predetermined duration, the applicator and the metering blade are each moved out of contact with the image transfer surface; and print operations are enabled after moving the applicator and the metering blade out of contact with the image transfer surface.

12. The imaging device of claim 11, wherein the release agent application system further comprises:

a vent tube operatively connected to the reservoir for venting the reservoir to ambient pressure; and a solenoid valve operatively connected to the vent tube wherein, during the maintenance cycle, the solenoid valve is opened prior to pumping release agent to the reclaim receptacle.

13. The imaging device of claim 11, further comprising:

a user interface;

wherein, during the maintenance cycle, an alert is generated via the user interface indicating that a maintenance cycle is being performed.

14. The imaging device of claim 11, wherein the predetermined duration is approximately 120 seconds.

15. The imaging device of claim 11, further comprising:

an ink loader configured to receive solid ink sticks, to melt the solid ink sticks to a molten liquid ink, and to deliver the molten liquid ink to the printing system.

16. The imaging device of claim 11, wherein, during the maintenance cycle, the metering blade is maintained in contact for a predetermined delay after the applicator is moved out of contact with the image transfer surface.

17. The imaging device of claim 11, wherein the sump pump is activated during the maintenance cycle.

18. The imaging device of claim 11, wherein the delivery pump system is activated for approximately 60 seconds to pump release agent to the reclaim receptacle during the maintenance cycle.

* * * * *